United States Patent [19]

Swanson

[11] 4,330,952

[45] May 25, 1982

[54] POSTER FRAME

[76] Inventor: Robert G. Swanson, Rte. 3, Box 170, Alexandria, Minn. 56308

[21] Appl. No.: 249,999

[22] Filed: Mar. 30, 1981

[51] Int. Cl.[3] ..... G09F 1/12

[52] U.S. Cl. ..... 40/155; 40/10 R; 40/152.1

[58] Field of Search ..... 40/152, 152.1, 153, 40/155, 10 R, 617

[56] References Cited

U.S. PATENT DOCUMENTS

| | | | |
|---|---|---|---|
| 975,094 | 11/1910 | Williams | 40/152 |
| 2,540,907 | 2/1951 | Paschal | 40/153 |
| 2,954,630 | 10/1960 | Hull | 40/152.1 |
| 3,812,609 | 5/1974 | Volden | 40/153 |
| 4,145,827 | 3/1979 | Katsufrakis | 40/152 |

*Primary Examiner*—Gene Mancene
*Assistant Examiner*—Wenceslao J. Contreras
*Attorney, Agent, or Firm*—Harvey B. Jacobson

[57] ABSTRACT

A pair of elongated upper and lower horizontal frame bars are provided together with a pair of upstanding opposite side frame bars. The upstanding opposite side frame bars extend between and loosely end abutting the lower and upper surfaces of the corresponding end portions of the upper and lower frame bars and all of the bars include inner and outer sides with the inner sides having coplanar grooves formed therein and extending longitudinally thereof for receiving the corresponding marginal edges of a poster bound on its edges by the frame bars and with the poster member forming a keying element engaged in the slot of each frame bar and thus keying the bars together, each against lateral displacement relative to the other frame bars transversely of the plane of the associated poster. The opposite end portions of the upper and lower frame bars project outwardly of the outer sides of the upper and lower ends of the corresponding side frame bars and the end portions include upstanding bores formed therethrough immediately outwardly of the outer surfaces of the corresponding side frame bars. The opposite end of an elongated flexible tension member are threaded downwardly through the bores in the ends of the upper frame bar and also downwardly through the bores in the ends of the lower frame bar and are knotted through the last mentioned bores with the midportion of the tension member being upwardly displaceable from the upper frame bar and engageable with a suitable suspension member.

9 Claims, 4 Drawing Figures

POSTER FRAME

BACKGROUND OF THE INVENTION

Various forms of frames heretofore have been provided for pictures, posters and the like. However, most of these previously known forms of frames use a suitable backing member for the picture or poster to be supported from the frame and the frame must thus be tailored for a particular size of picture or poster.

Accordingly, a need exists for a picture or poster frame requiring only the use of marginal frame members to thereby eliminate the need for a backing member and to enable the size of the frame to be more readily varied merely by changing the length of the side frame members.

Examples of various forms of frames including some of the general structural and operational features of the instant invention are disclosed in U.S. Pat. Nos. 236,953, 416,925, 473,706, 700,548, 1,603,796 and 2,540,907. However, these previously known forms of frames are not readily adaptable for use in conjunction with relatively flimsy picture or posters without the use of a backing member for the picture or poster.

BRIEF DESCRIPTION OF THE INVENTION

The frame of the instant invention comprises only a pair of upper and lower horizontal frame bars and a pair of upstanding opposite side frame bars disposed and extending between corresponding ends of the upper and lower frame bars. The frame bars each include inner and outer sides and the inner sides of the frame bars include longitudinal central grooves formed therein and extending longitudinally therealong for seatingly receiving the corresponding upper, lower and opposite side marginal edges of the associated picture or poster. The opposite end portions of the upper and lower frame bars project endwise outwardly beyond the outer sides of the corresponding side bars and include vertical bores formed therein immediately adjacent the outer surfaces of the opposite side bars. An elongated flexible tension member has its opposite end portions threaded downwardly through the bores formed in the opposite ends of the upper frame bar and thereafter downwardly through the bores formed in the opposite ends of the lower frame bar. The free ends of the tension member are then knotted to prevent their withdrawal upward through the bores formed in the opposite ends of the lower frame bar and the midportion of the tension member may be displaced upwardly from the outer surface of the upper frame bar and engaged with a suitable suspension member. With the upper, lower and opposite side marginal edges of the associated picture or poster keyed in the grooves formed on the inner surfaces of the upper, lower and opposite side frame bars, the bars are keyed together each against lateral displacement relative to the plane of the associated picture or poster relative to the other frame bars.

The main object of this invention is to provide a picture or poster hanging from which may be utilized to attractively frame and support a picture or poster.

Another object of this invention is to provide a frame in accordance with the preceding object and which may be readily manufactured and marketed in different sizes for use with different size pictures and posters.

Still another object of this invention is to provide a frame whose component parts may be only loosely assembled and which therefore allow the frame to be readily disassembled for storage or transport when not in use.

A final object of this invention to be specially enumerated herein is to provide a poster frame in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
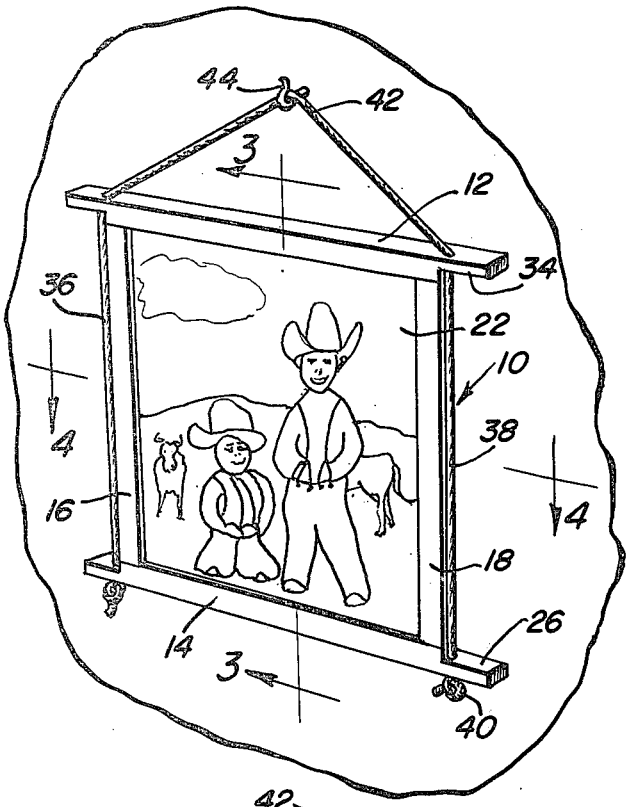
FIG. 1 is a perspective view of the frame in operative associated with a poster and with the frame suspended from a suitable support member.
Figure 3:
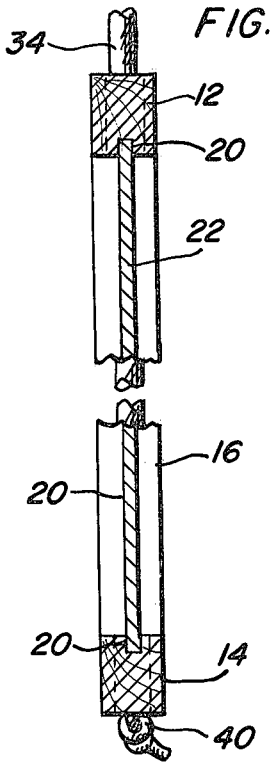
FIG. 3 is an enlarged fragmentary vertical sectional view taken substantially upon the plane indicated by the section line 3—3 of FIG. 1.

Referring now more specifically to the drawings, the numeral 10 usually designates the frame of the instant invention. The frame 10 includes upper and lower horizontal frame bars 12 and 14 and a pair of upstanding opposite side frame bars 16 and 18. The frame bars 12, 14, 16 and 18 include inner and outer sides and the inner sides of the bars include elongated, central and longitudinally extending inwardly outing grooves 20 formed therein. The upper and lower bars 12 and 14 and the upstanding opposite side bars 16 and 18 may be arranged at the upper, lower and opposite side marginal portions of a poster 22 with the marginal edges of the poster seatingly received in the corresponding grooves 20.

Figure 2:
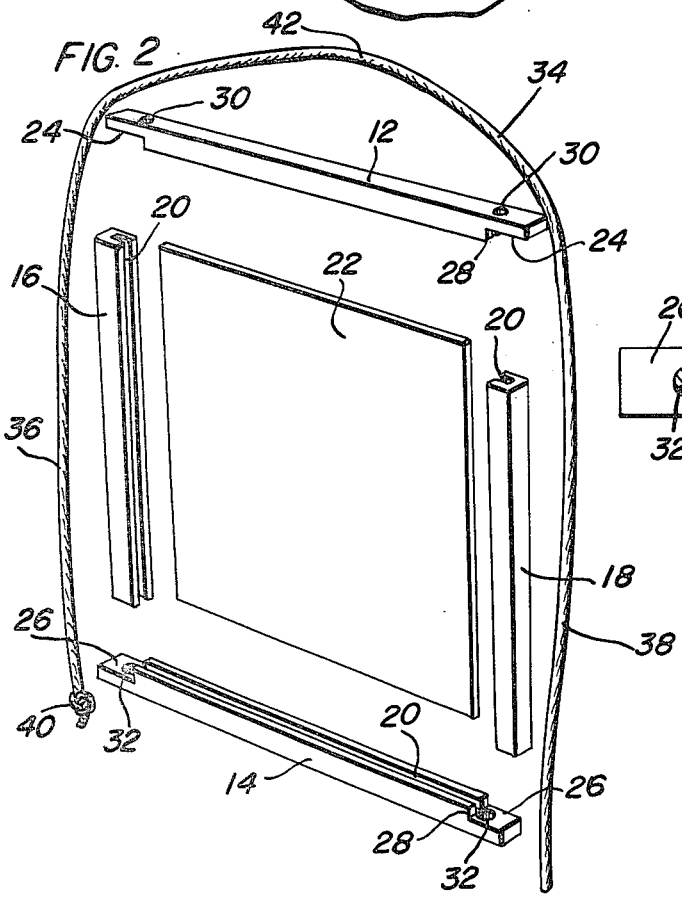
FIG. 2 is a perspective view of the frame in disassembled condition.
Figure 4:
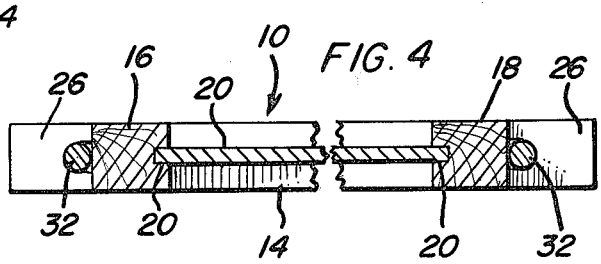
FIG. 4 is a fragmentary enlarged horizontal sectional view taken substantially upon the plane indicated by the section line 4—4 of FIG. 1.

Of course, the length of the upstanding opposite side frame bars 16 and 18 is equivalent to the longitudinal extent of the opposite side upstanding marginal edges of the poster 22, minus the combined depth of the grooves 20 formed in the upper and lower horizontal frame bars 12 and 14, and it may be seen from FIGS. 1, 2 and 4 of the drawings that the opposite ends of the upper and lower horizontal frame bars 12 and 14 include downwardly and upwardly opening notches 24 and 26 formed therein with the notches 24 and 26 also opening endwise outwardly of the corresponding ends of the frame bars 12 and 14.

The length of the upper and lower frame bars 12 and 14 is such that the outer surfaces of the side frame bars 16 and 18 are flush with the inner extremities 28 of the notches 24 and 26 remote from the free ends of the upper and lower horizontal frame bars 12 and 14. In addition, the notched and portions of the upper and lower frame bars 12 and 14 include upstanding bores 30 and 32 formed therein immediately adjacent the inner extremities 28 of the notches 24 and 26.

With the frame bars 12, 14, 16 and 18 arranged relative to the poster 22 in the manner illustrated in FIG. 1 of the drawings, the engagement of the marginal portions of the poster 22 with the frame bars 12, 14, 16 and 18 keys the frame bars 12, 14, 16 and 18 together in a frame defining association against individual lateral displacement of any one of the frame bars relative to the other frame bars.

In order to support the frame 10, the latter includes an elongated flexible tension member 34 including opposite end portions 36 and 38. The end portions 36 and 38 are threaded downwardly through the bores 30 and 32 on the corresponding sides of the frame 10 and the free ends of the tension member 36 are knotted as at 40 while the longitudinal midportion of the tension member 42 may be upwardly displaced relative to the upper frame member 12 and engaged with a suitable suspension hook 44, see FIG. 1.

The diameter of the tension member 34 is greater than the width of the grooves 20 whereby the opposite ends of the grooves 20 formed in the upper and lower frame bars 12 and 14 are hidden by the adjacent sections of the tension member 34. Inasmuch as the opposite end portions 36 and 38 of the tension member 34 are disposed immediately outwardly of the outer surfaces of the opposite side frame bars 16 and 18, the side frame bars 16 and 18 are restrained against movement outwardly of the corresponding marginal edges of the poster 22.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A poster frame for framing and hanging a poster, said frame including elongated upper and lower horizontal frame bars and a pair of upstanding opposite side frame bars extending between and loosely end abutting the lower and upper sides of the corresponding end portions of said upper and lower bars, said bars including inner and outer sides, said inner sides including coplanar grooves formed therein and extending longitudinally thereof for seatingly receiving the corresponding marginal edges of a poster bound on its edges by said frame bars and with said poster forming a keying element engaged in the groove of each frame bar and thus keying said bars together, each against lateral displacement transversely of the plane of said poster, said opposite end portions of the upper and lower frame bars projecting outwardly of the outer sides of the upper and lower ends of the corresponding side frame bars, said end portions including upstanding bores formed therethrough immediately outward of the outer surfaces of the corresponding side frame bars, and a pair of upstanding elongated flexible tension member sections each including upper and lower longitudinally spaced portions thereof passed through bores in one pair of corresponding ends of said upper and lower frame bars, the lower ends of said tension member sections being secured through the bores in the end portions of the lower frame bar and the upper ends of said tension member sections being upwardly convergent and joined at a point above said upper frame bar for hanging support of said tension member sections, and thus said frame, from a suitable support.

2. The combination of claim 1 wherein said tension member sections comprise opposite end portions of the single tension member with said upper ends of said tension member sections being integrally formed and said lower ends comprising the opposite ends of said single tension member.

3. The combination of claim 1 wherein the said lower ends of said tension member sections are secured through the bore formed in the opposite end portions of said lower frame bar by knotting said lower ends on the underside of said lower frame bar.

4. The combination of claim 1 wherein the lower and upper sides of the upper and lower frame bars, respectively, have downwardly and upwardly opening notches formed therein immediately outwardly of the upper and lower ends of said side frame bars.

5. The combination of claim 4 wherein said notches also open endwise outwardly of the opposite end portions of said upper and lower frame bars.

6. The combination of claim 5 wherein said bores are formed in the innermost extremities of said notches remote from the terminal ends of said upper and lower frame bars.

7. The combination of claim 6 wherein said bores and tension member sections are of greater diameter than the width of said grooves.

8. The combination of claim 7 wherein said tension member sections comprise opposite end portions of the single tension member with said upper ends if said tension member sections being integrally formed and said lower ends comprising the opposite ends if said single tension member.

9. The combination of claim 8 wherein the said lower ends of said tension member sections are secured through the bore formed in the opposite end portions of said lower frame bar by knotting said lower ends on the underside of said lower frame bar.

* * * * *